United States Patent [19]

Hellebrand et al.

[11] Patent Number: 4,726,413

[45] Date of Patent: Feb. 23, 1988

[54] APPARATUS FOR FILLING EVACUATED CAVITIES IN MATERIAL OR, RESPECTIVELY, IN BODIES

[75] Inventors: Johannes Hellebrand, Munich; Irene Rossner, Unterhaching, both of Fed. Rep. of Germany

[73] Assignee: Siemens Aktiengesellschaft, Berlin and Munich, Fed. Rep. of Germany

[21] Appl. No.: 839,102

[22] Filed: Mar. 13, 1986

[30] Foreign Application Priority Data

Mar. 18, 1985 [DE] Fed. Rep. of Germany ..... 3509746

[51] Int. Cl.[4] ..... B22D 19/00; B05D 1/18; B05D 3/12

[52] U.S. Cl. ..... 164/98; 164/114; 164/289; 118/52; 118/55; 427/431; 427/241

[58] Field of Search ..... 164/98, 114, 289, 290, 164/286; 118/52, 55; 427/431, 241

[56] References Cited

U.S. PATENT DOCUMENTS

| | | | |
|---|---|---|---|
| 2,339,141 | 1/1944 | Brown | 164/98 |
| 3,112,633 | 12/1963 | Wilkinson, Jr. | 118/52 |
| 3,679,950 | 7/1972 | Rutt | 427/431 |
| 3,965,552 | 6/1976 | Rutt | 427/431 |
| 4,030,004 | 6/1977 | Rutt | 427/431 |
| 4,063,863 | 12/1977 | Hilmoe | 164/289 |
| 4,192,250 | 3/1980 | van Duijn | 118/52 |
| 4,241,005 | 12/1980 | Rothschild et al. | 118/52 |

FOREIGN PATENT DOCUMENTS

| | | | |
|---|---|---|---|
| 150240 | 8/1985 | European Pat. Off. | 164/114 |

OTHER PUBLICATIONS

Linn Elektronic brochure entitled "Induktherm 3,3 μP, Induktherm 6,6 μP for Laboratory Furnaces, High Frequency Heating, High-Temperature Technics".

*Primary Examiner*—Nicholas P. Godici
*Assistant Examiner*—Samuel M. Heinrich
*Attorney, Agent, or Firm*—Hill, Van Santen, Steadman & Simpson

[57] ABSTRACT

There is disclosed herein an embodiment of a vacuum centrifuge device for employment for filling cavities in material or in bodies such as, for example in ceramic multi-layer capacitors, with molten material, for example, metal.

A chamber (12) in the device includes an outlet opening for the molten material, fashioned as a flow throttle (16), which is dimensioned, such that a dynamic pressure acting on all sides arises for a prescribed time span in the molten material (20) situated in the chamber (12) of the device, this dynamic pressure leading to the filling (of the cavities) in the material or in the bodies (15).

2 Claims, 1 Drawing Figure

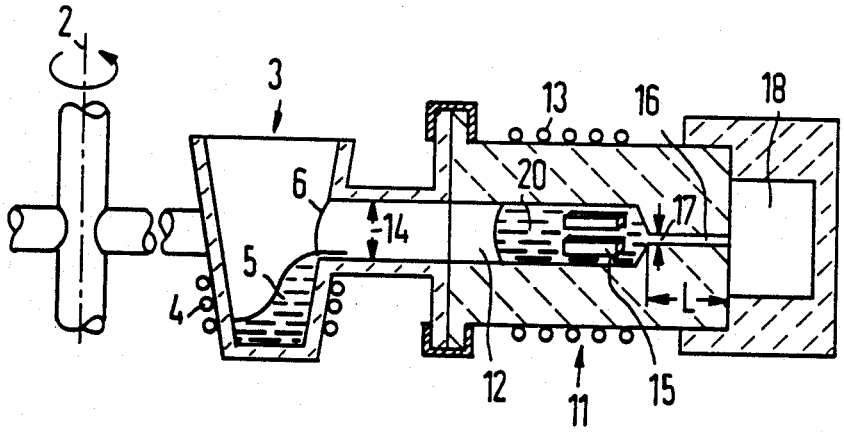
2
3
6
5
4
14
13
16
18
20
17
L
12
11
15

APPARATUS FOR FILLING EVACUATED CAVITIES IN MATERIAL OR, RESPECTIVELY, IN BODIES

BACKGROUND OF THE INVENTION

This invention relates to a casting apparatus for use in filling internal cavities in a material or body with molten material which is allowed to solidify, and more particularly, to an improved centrifugal casting apparatus.

Centrifugal casting apparatus are employed to fill cavities within a body with, for example, molten metal such as lead, or with impregnating material such as a synthetic resin, or the like. Such cavities can be open pores in, for example layers, such as electrode layers of porous material. Cavities to be considered herein can also be cavities existing in bodies, for instance in the nature of caverns such as, for example, in the manufacture of multi-layer ceramic capacitors (see U.S. Pat. Nos. 3,679,950; 3,965,552; and 4,030,004) or such as generated in multi-layer wirings in ceramic substrate plates in the respective manufacturing steps. The pores and the cavities present in the bodies are of the open cell-type (i.e., open toward the outside) namely in order to permit filling with the molten material in, preferably, an evacuated environment.

Linn Elektronik, D 8549 Hirschbach, [Federal Republic of Germany] (see brochure number 02/85-2/2000 Schleuderarm Vacuumausfühurung) manufactures apparatus with which test specimens can be manufactured by spin casting. The apparatus comprises a crucible for melting metal contained therein (of which the specimens are to be cast) and the casting mold. The melting crucible is radially spaced from the centrifugal axis in the centrifugal device so that upon rotation, molten material contained in the crucible rises along a sloped or obliquely directed wall and, when a sufficient centrifugal force has been reached, the molten material reaches an outlet opening in the melting crucible. The molten material flows out of the crucible through this outlet opening into a casting mold spaced radially further from the centrifugal axis. The molten material introduced into this casting mold under centrifugal pressure remains therein until it has solidified. As is standard in spin casting, a relatively dense cast structure is produced.

Using features of the principle of spin casting, the object of the present invention is to provide an apparatus for filling cavities in material or in bodies, whereby an optimum degree of filling of such cavities is achieved with the assistance of specific developments of these measures.

These and other objects of this invention will become apparent from the following description and appended claims.

SUMMARY OF THE INVENTION

The present invention is based on departing from the principle, always applied both in spin casting as well as in vacuum filling, of cavities in, for example, multi-layer capacitors and multi-layer wirings, to provide a sack-like space for the casting mold or for the chamber in which the filling is to ensue.

In this invention, the chamber in which the filling of the cavities of the material or of the bodies is to be executed also has at least one outlet opening for the molten material in addition to the inlet opening, which is standard for the casting mold. This outlet opening or openings forms a flow throttle for which a prescribable or predetermined flow resistance can be selected. The invention is based on a principle that the molten material, for example the molten metal, is essentially suddenly delivered into the chamber through a first inlet opening. As the chamber is filled, a part of the supplied material flows out through the outlet opening, which is fashioned as a flow throttle. This outflow is important and the outlet opening is dimensioned in accord with the invention, such that a hydrostatically acting dynamic pressure which effects the filling is established for a prescribable time in the chamber in which the material to be filled or the body to be filled is present.

As is standard in such filling, the chamber, and, thus the cavities of the material or the bodies to be filled, are evacuated. Moreover, a plurality of bodies with cavities to be filled can be situated in the chamber for simultaneous filling.

An essential particularity of the invention is that the excess of supplied molten material present in the chamber at the end of the time span provided for the filling flows off through the outlet opening. Since the molten material has only been supplied in more or less one pulse, only the material or bodies filled with the molten material ultimately remain in the chamber. The filled material or bodies are then removed from the chamber.

BRIEF DESCRIPTION OF THE DRAWINGS

The FIGURE shows that part of the apparatus which is relevant to the present invention, whereby the apparatus "Schleuderarm-Vakuumausfühurung" of the aforementioned brochure is referenced.

DESCRIPTION OF THE PREFERRED EMBODIMENT

In the FIGURE, numeral 2 references the rotational axis of the centrifugal device. The melting crucible 3 with its heating element 4 is attached radially relative to the centrifugal axis 2. Molten material 5 in the melting crucible 3 is shown in the condition in which the molten material has just risen into the outlet opening 6 in the melting crucible as a result of the centrifugal force. The molten material 5 proceeds into a part 11 of the apparatus in which the chamber 12 is defined. The chamber 12, for example, is defined by a bore extending into the part 11. The interior of the chamber 12 can be heated with the assistance of a heating element 13. The double arrow 14 identifies the inlet opening of the chamber 12 referred to as a first opening. It has a first cross section.

The bodies 15 introduced into the chamber 12 have cavities that are to be filled.

The outlet opening 16 of the chamber 12 acts as a flow throttle. Its length L is selected of such length and its cross section, indicated by 17, is selected so narrow that molten material 20 which more or less suddenly enters into the chamber 12 through the inlet cross section 14 will slowly flow off through the outlet opening 16 subject to a great retardation. The molten material which has passed through the opening 16 is collected in the radially outward space 18.

As a consequence of the throttle effect in the outlet opening 16, a hydrostatic pressure (i.e., a pressure acting on all sides) arises within the molten material 20 in the chamber 12 under the centrifugal force within the chamber 12 and in the region of the bodies 15, which bodies are filled with the molten material under the hydrostatic pressure. This pressure increases within the molten material 20 situated in the chamber 12 dependent on the distance from the centrifugal axis 2.

The FIGURE basically shows two states or stages which are actually chronologically successive. Those stages are the points in time of (1) passage of the molten material 5 from the crucible 3 into the chamber 12 and (2) the molten material 20 is only situated in the chamber 12. After an even further time lapse, practically all of the molten material 20 in the chamber 12 has flowed off from the chamber 12 through the outlet opening 16. The effective hydrostatic pressure has thereby steadily decreased during the entire time sequence from a maximum value at the point in time of the maximum filling of the chamber 12 with the molten material 20, down to the value 0 when the molten material has flowed out. As a result of the measures set forth in greater detail below which are known in and of themselves, however, molten material which has penetrated into the cavities of the bodies 15 remains contained therein and solidifies with the subsequent cooling.

Not shown in greater detail for the sake of clarity is that part of the apparatus with which the interior of the chamber 12 and, thus, the cavities of the bodies 15 as well as the interior of the crucible 3 and of the space 18 are to be evacuated. Corresponding seals required for this purpose are likewise not shown in detail in the illustration.

With, for example, copper as the molten material 5, 20, the residence time in the chamber of 24, of 4.8 and of 1.5 seconds can be obtained given a channel length L=20 mm of the outlet opening 16 for diameters of the outlet openings 16 of 0.2, of 0.3 and of 0.4 mm. These times derive for the time from the entry of the molten material 5 in the chamber 12, i.e., from the beginning of the outflow from the chamber 12, up to the complete outflow of the molten material 20 present in the chamber 12 that has not been absorbed in the cavities. Relevant operational factors are a rotational speed of 1500 rpm, a distance of 250 mm from the centrifugal axis 2 to the inlet opening of the outlet opening 16, a diameter of 20 mm for the chamber 12, and a filling "level" of 50 mm for the molten material 20 in the chamber 12. The maximum pressure occurring in the molten material 20 at the inlet opening of the outlet opening thereby reaches a value up to about 25 bar.

Among other things, multi-layer ceramic capacitors can be manufactured with the apparatus of the invention, i.e., the cavities thereof initially provided and present in the sintered ceramic body for the electrodes can be filled with metal. The aforementioned U.S. Pat. Nos. 3,679,950; 3,965,552; and 4,030,004 show such a capacitor, particularly in their respective FIGS. 1. It is advantageous for such a ceramic capacitor and also for cases of comparably dimensioned cavities in a body to have the openings necessarily present for filling the provided cavities "closed" with a material in the fashion of a plug in such a way that there is a passage for the entry of the molten material provided for the filling. It should thereby be taken into consideration that the filling is executed under the pressure of the centrifugal force. This closing material, however, has such narrow through pores that molten material which has once penetrated into the cavities does not re-emerge through the passages of this plug, when in the final phase of the operation of an apparatus of the invention, essentially all molten material present outside of the bodies 15 situated in the chamber 12 has flowed out of the chamber 12 through the outlet opening 16. This does not represent a problem for a person skilled in the art since the measures known from the aforementioned publications can be employed for this purpose. Given the ceramic capacitors of the aforementioned U.S. patents, the electrodes such as 17 and 19 in U.S. Pat. No. 4,030,004 act as such closing material.

Although the invention has been described with respect to preferred embodiments, it is not to be so limited as changes and modifications can be made which are within the full intended scope of the invention as defined by the appended claims.

We claim as our invention:

1. An apparatus for filling cavities present in a material with an initially molten material which subsequently solidifes, comprising a centrifuge having a centrifugal axis for impressing said molten material into said cavities under pressure from said centrifuge and acting on all sides of a body characterized in that:

chamber (12) defining means are provided for the acceptance of said material radially situated in said centrifuge, said chamber means having a first opening adjacent said centrifugal axis and a second opening remote from said centrifugal axis and said first opening and heating means provided in association with said chamber defining means;

said first opening being an inlet opening and having a first cross section (14) and said first opening being aligned generally parallel to said centrifugal axis;

means defining a crucible having a melt of molten material therein positioned upstream of said first opening between the first opening and centrifugal axis and there also being provided heating means associated with said crucible, said first opening being situated in a side wall of said crucible means at a position effective to deliver molten material beginning at a preselected rotational speed;

said second opening being an outlet opening for flow of excess molten material, said outlet opening being fashioned as a flow throttle (16) having a second cross section (17) and a length (L);

said first cross section (14) is dimensioned so that the quantity of molten material (20) in said apparatus to be supplied into said chamber (12) at a prescribed point in time passes through this first cross section (14) without time delay; and said second cross section (17) and said length (L) of said flow throttle (16) are selected so as to be effective during operation so that a dynamic pressure is formed in said chamber (12) due to the flow resistance occurring during the flow of part of said molten material in said flow throttle (16), said dynamic pressure being formed within said molten material (20) contained in said chamber (12) for a prescribable time span within which said cavities are filled by means of said dynamic pressure.

2. A process for centrifugally filling internal cavities in a body with a molten material using a centrifugal casting apparatus which includes a filling chamber within which the bodies are positioned, comprising the steps of:

filling the chamber with a molten material for impregnation to the internal cavities of said body; and controllably draining molten material from said chamber while impregnating the internal cavities of the body under a dynamic pressure.

* * * * *